US007137808B2

(12) United States Patent
Branston et al.

(10) Patent No.: US 7,137,808 B2
(45) Date of Patent: Nov. 21, 2006

(54) METHOD AND DEVICE FOR INFLUENCING COMBUSTION PROCESSES INVOLVING COMBUSTIBLES

(75) Inventors: David Walter Branston, Effeltrich (DE); Günter Lins, Erlangen (DE); Jobst Verleger, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 77 days.

(21) Appl. No.: 10/485,401

(22) PCT Filed: Jul. 31, 2002

(86) PCT No.: PCT/DE02/02815

§ 371 (c)(1),
(2), (4) Date: Jan. 30, 2004

(87) PCT Pub. No.: WO03/014622

PCT Pub. Date: Feb. 20, 2003

(65) Prior Publication Data

US 2004/0185397 A1 Sep. 23, 2004

(30) Foreign Application Priority Data

Aug. 1, 2001 (DE) ..... 101 37 683

(51) Int. Cl.
*F23C 5/00* (2006.01)
*F23M 3/02* (2006.01)

(52) U.S. Cl. ..... 431/8; 431/2

(58) Field of Classification Search ..... 431/2, 431/3, 8, 12; 95/57, 73; 96/15
See application file for complete search history.

(56) References Cited

U.S. PATENT DOCUMENTS

| | | | | |
|---|---|---|---|---|
| 3,231,484 | A * | 1/1966 | Berghaus | 204/164 |
| 3,269,446 | A * | 8/1966 | Luther | 431/172 |
| 3,416,870 | A | 12/1968 | Wright et al. | |
| 3,841,824 | A * | 10/1974 | Bethel | 431/8 |
| 4,111,636 | A | 9/1978 | Goldberg | |
| 5,784,889 | A | 7/1998 | Joos et al. | |

FOREIGN PATENT DOCUMENTS

| | | |
|---|---|---|
| JP | 61-036607 | 2/1986 |
| JP | 03-164602 | 7/1991 |
| WO | WO 96/01394 | 1/1996 |

OTHER PUBLICATIONS

Hartwell F. Calcote, et al., Industrial and Engineering Chemistry 43(1951), Seiten 2726 bis 2731.
H.F. Calcote, et al., "Increased Methane-Air Stability Limits by a DC Electric Filed".
R.I. Noorani, et al., "Effects of Electric Fields on the Blowoff Limits of a Methane-Air Flame", vol. 23, No. 9.
M. Kono, et al., "The Effect of Nonsteady Electric Fields on Scooting Flames".
Masahiro Saito, et al., "Control of Soot Emitted from Acetylene Diffusion Flames by Applying an Electric Fields".
C.H. Berman, et al., "NOx Reduction in Flames Stabilized by an Electronic Field".

(Continued)

*Primary Examiner*—Alfred Basichas
(74) *Attorney, Agent, or Firm*—Harness, Dickey & Pierce P.L.C.

(57) ABSTRACT

A method and device are for influencing combustion processes, and include an electrical device. The electrical device engages with the flame front so that the electrical field thus produced, only penetrates areas of the flame front in which a stabilizing and harmful-substance-reducing effect is produced. The electrodes of the burner are arranged outside the region of the flame in the associated device.

7 Claims, 6 Drawing Sheets

OTHER PUBLICATIONS

Figure 1:
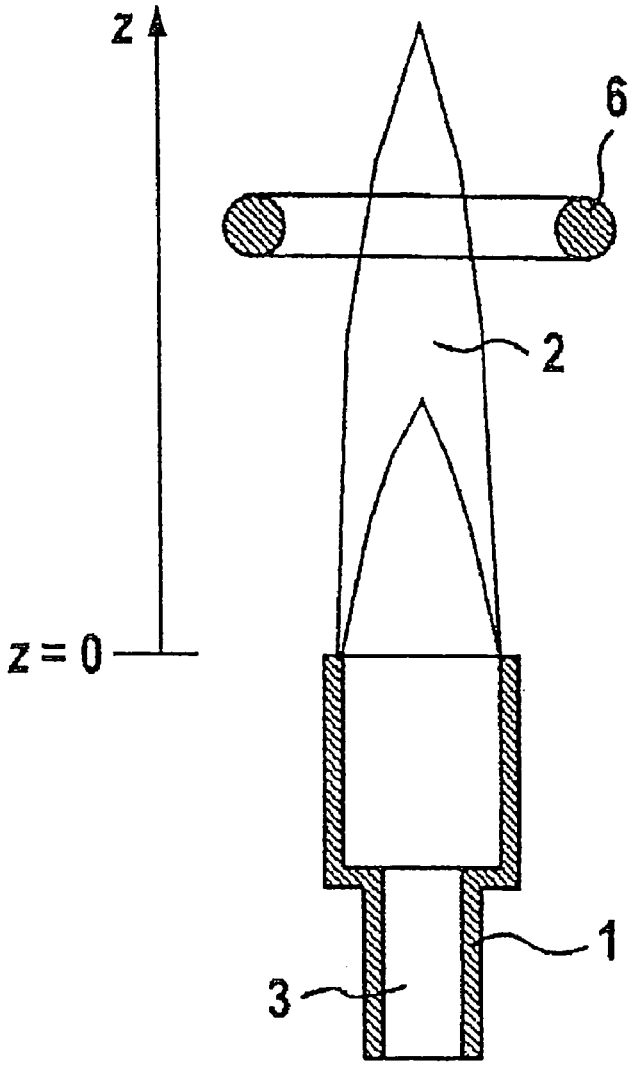
FIG 1 (Prior Art)

A.B. Vatazhin, et al., "Effect of an Electric Field on the Nitrogen Oxide Emission and Structure of a Laminar Propane Diffusion Flame".

Derek Brandley, et al., "Electronic Coronas and Burner Flame Stability".

* cited by examiner

METHOD AND DEVICE FOR INFLUENCING COMBUSTION PROCESSES INVOLVING COMBUSTIBLES

This application is the national phase under 35 U.S.C. § 371 of PCT International Application No. PCT/DE02/02815 which has an International filing date of Jul. 31, 2002, which designated the United States of America and which claims priority on German Patent Application number DE 101 37 683.9 filed Aug. 1, 2001, the entire contents of which are hereby incorporated herein by reference.

FIELD OF THE INVENTION

The invention generally relates to a method for influencing combustion operations or processes involving combustibles, including fuels. Preferably, it relates to a method in which electrical devices are used to guide and/or alter a flame at a burner. In addition, the invention also generally relates to a device for carrying out the method; preferably using stabilizing, pollutant-reducing devices to influence the flame during the combustion operation.

BACKGROUND OF THE INVENTION

The advantageous influences which electric fields can have on combustion flames are known. According to the publications Industrial and Engineering Chemistry 43 (1951), pages 2726 to 2731, 12th Annual energy-sources technology conf. (1989), pages 25 to 31 and AIAA Journal 23 (1985), pages 1452 to 1454 the effects of the electric field reside in an improvement to the flame stability. According to Combust. Flame 78 (1989), pages 357 to 364 and Combust. Flame 119 (1999), pages 356 to 366 the carbon emissions are reduced. Further, according to

Fossil Fuel Combustion, ASME 1991, pages 71 to 75 and

Fluid Dynamics 30 (1995), pages 166 to 174 the emission of gaseous pollutants is reduced.

It is also known from Combust. Flame 55 (1984), pages 53 to 58 to influence combustion operations by electric discharges, in particular corona discharges. In this case too, the flame stability can be improved and the pollutant emissions can be reduced. Technical applications of the above-mentioned effects are described in WO 96/01394 A1, U.S. Pat. No. 3,416,870 A and U.S. Pat. No. 4,111,636 A.

A common feature of the known methods is that the electrodes which are required in order to generate the electric field or a discharge in the flame, are arranged in such a manner that the flame is either located between the field-generating electrodes or is surrounded by one electrode. This electrode can be identical to the combustion chamber. An arrangement of this nature is illustrated with reference to FIG. 1 of the description. In any event, it is possible to draw a straight connecting line between electrodes of opposite polarity in such a manner that the connecting line passes through the flame which is to be influenced.

In FIG. 1, the direction of propagation of a flame 2 or the direction of flow of the exhaust gases is indicated as the z direction. The location z=0 is determined by the position at which the solid, liquid or gaseous fuel is transformed into the flame. No significant ionization caused by the combustion process occurs at locations z<0.

Arrangements which correspond to the known art include at least one electrode or one or more parts of such an electrode extending exclusively or predominantly over areas where z>0. In this case, it is also possible for the combustion chamber which surrounds the flame to be an electrode or part of an electrode. In extreme cases, the arrangement is such that partial areas of the flame may touch an electrode. In any event, it is possible to draw a straight connecting line from one electrode to an electrode of opposite polarity in such a way that the connecting line passes through the flame.

One drawback of the known art described above is that the electric field which is generated by way of the electrodes passes through a large area of the flame, while the actual effect of the electric field occurs in what is known as the flame front. The flame front is a narrow area, compared to the dimensions of the flame, between the cold fuel and the flame in which the chemical reactions leading to the formation of the flame take place. Since the flame has an electrical conductivity which is not negligible, on account of the charge carriers contained therein, the fact that the electric field passes through wide areas of the flame indicates that an electric current flows throughout the flame area which is enclosed by the electrodes. This causes an increased energy consumption without contributing to the desired effect within the flame front. This is the case in particular if electrically conductive areas of the flame or its surroundings are in direct contact with the electrodes.

SUMMARY OF THE INVENTION

Working on this basis, it is an object of an embodiment of the invention to provide a method and to create the associated device which improve the influencing of combustion operations with fuels in a simple and economic way. The fuels to be used are in particular, although not exclusively, gases, preferably in premixed form.

According to an embodiment of the invention, an object may be achieved by a method for influencing combustion operations with fuels. An associated device forms the subject matter of another embodiment. Refinements to the method and/or device are further provided.

In one embodiment of the invention, the flame is exposed to the action of an electric field. The field is configured in such a way that it passes through only those areas of the flame in which it has a stabilizing, pollutant-reducing effect. For this purpose, in the associated device of another embodiment, electrodes are arranged and acted on by a voltage in such a way that an electric field preferably passes through those areas of the flame in which it produces its stabilizing, pollutant-reducing effect. This may be achieved by virtue of all the field-generating electrodes being arranged in areas in which no ionization or no significant ionization brought about by the combustion process occurs. This condition may be satisfied if the electrodes are arranged on the side of the burner not facing the burner mouth, such that no straight line can be drawn, between the electrodes, that passes through the flame.

Particular advantages of an embodiment of the invention result if the system is assigned sensors and control devices which control the voltage applied to the electrodes in such a way that the combustion process is influenced in the desired way. There are advantageously sensors, one of which measures the frequency of any combustion oscillation which may be present and another of which measures the pollutant concentration in the exhaust gas. The sensors supply the input signal to a control unit which controls frequency, amplitude and phase of the voltage applied to the electrodes in such a way that the combustion oscillations and/or the pollutant concentration are minimized.

Figure 2:
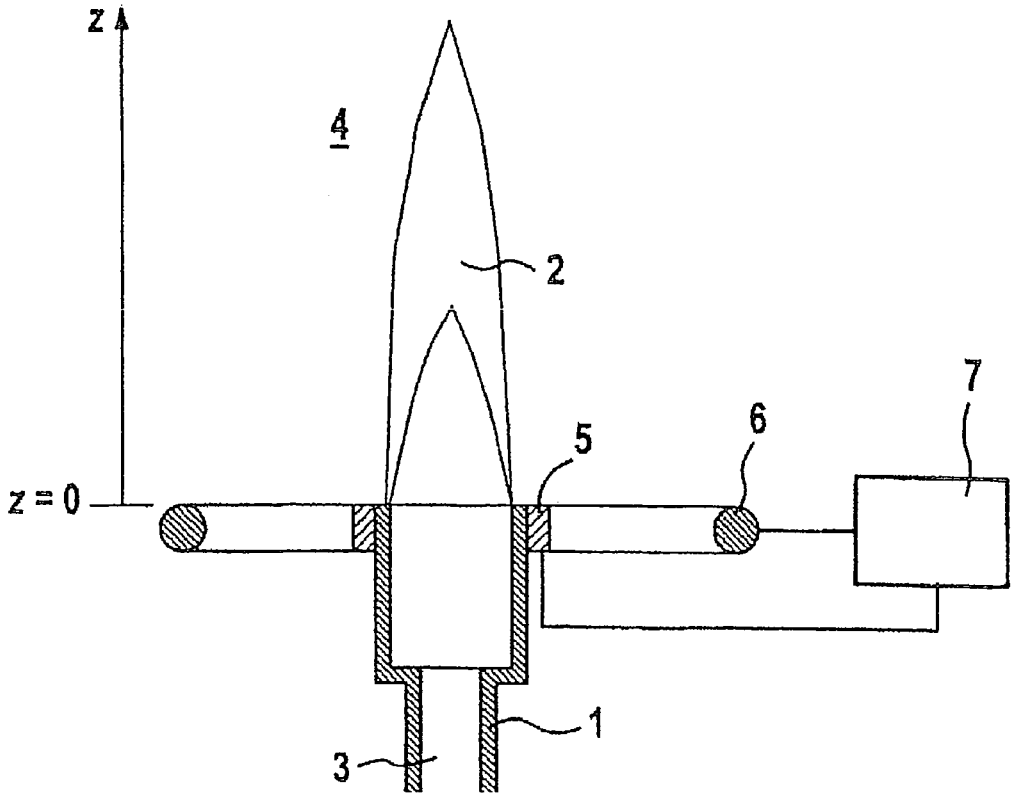
Figure 3:
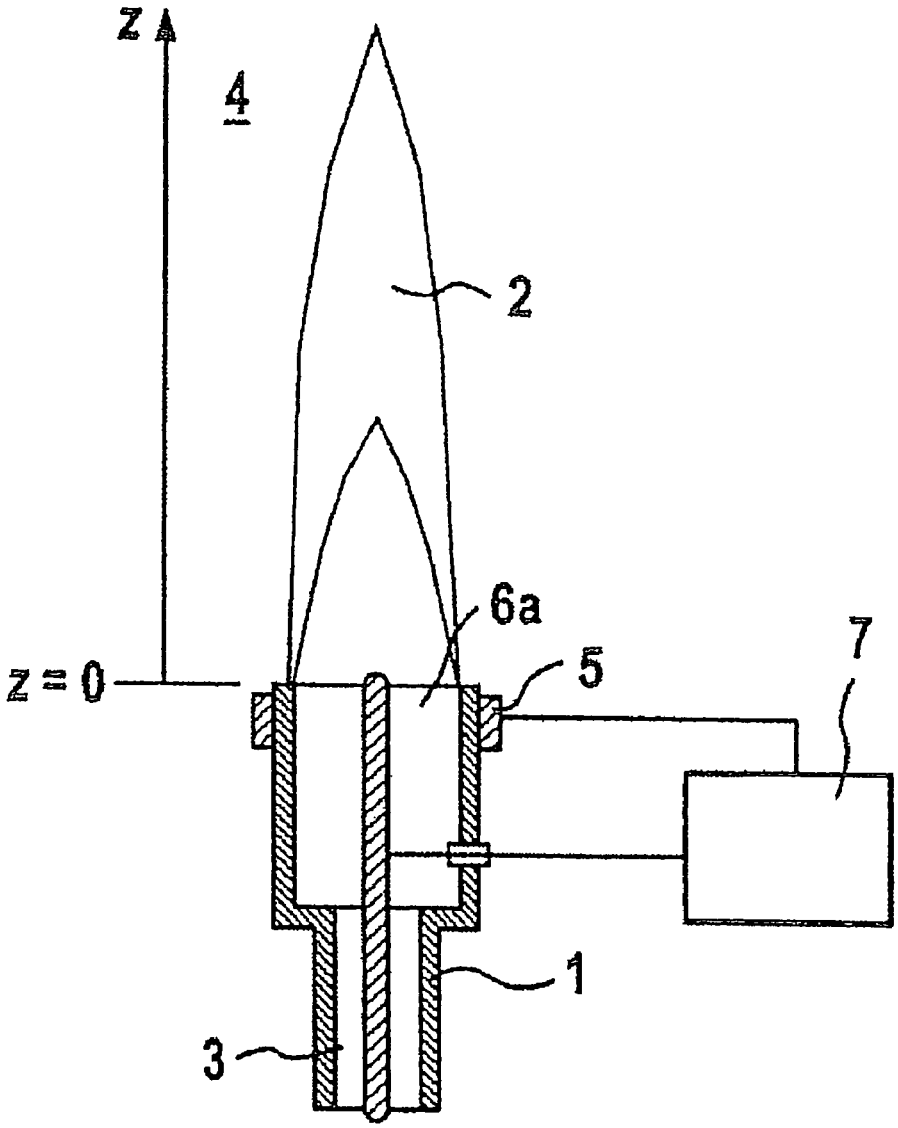
Figure 4:
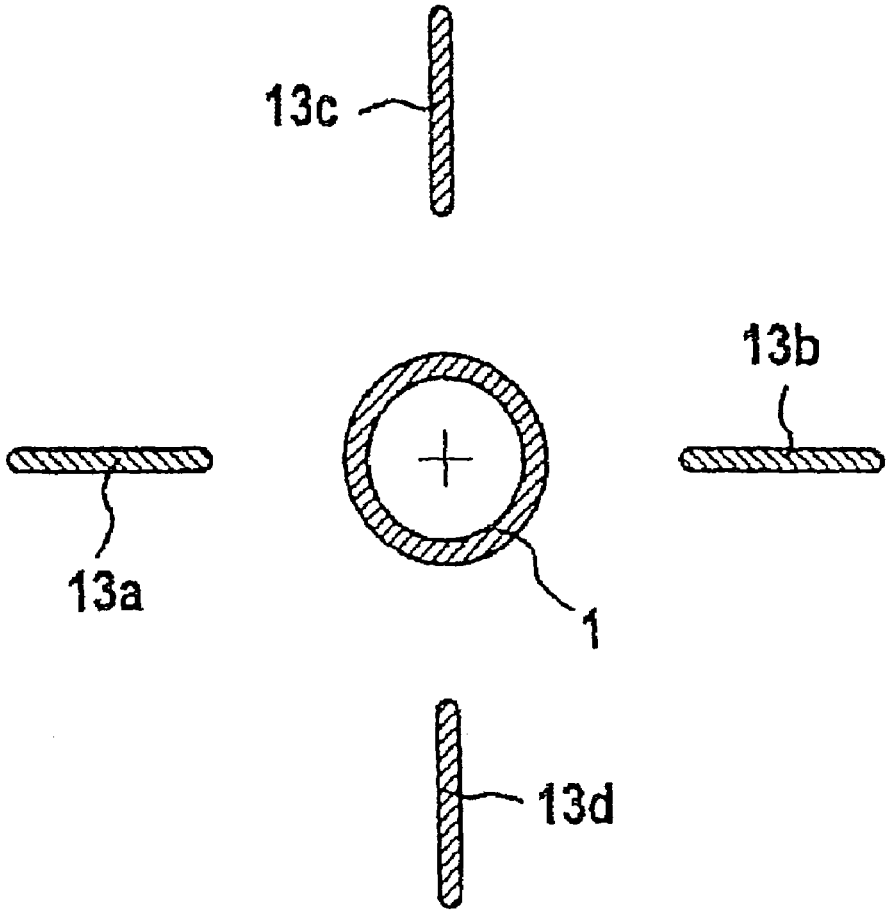
Figure 5:
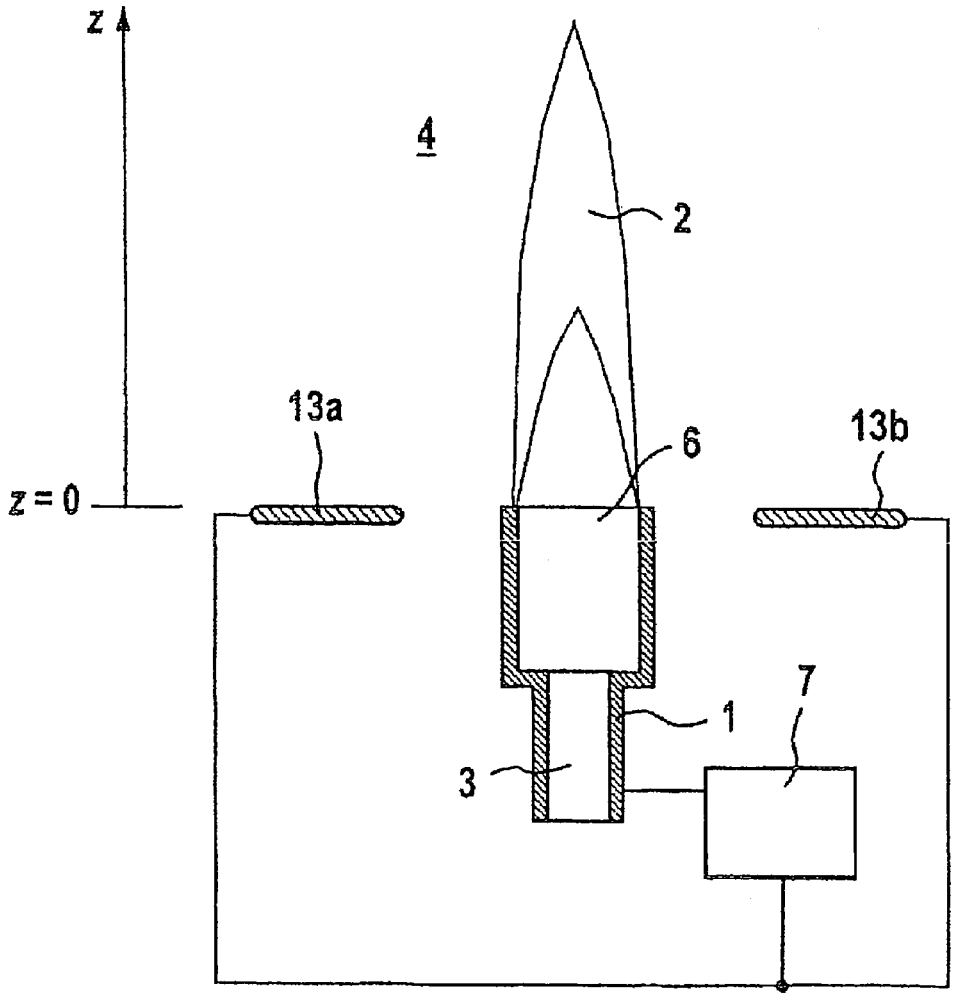
Figure 6:
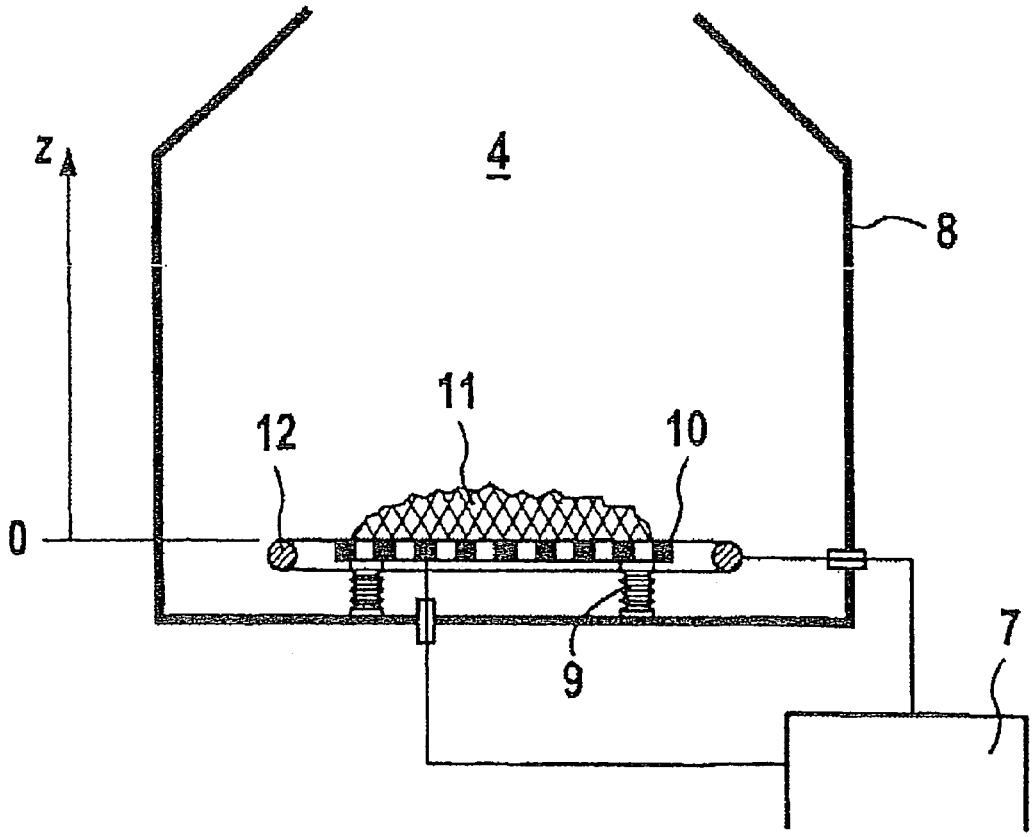

Further advantages, features and details of the invention will become evident from the description of illustrated exemplary embodiments given hereinbelow and the accompanying drawing, which is given by way of illustration only and thus is not limitative of the present invention, wherein:

FIG. 1 diagrammatically depicts an arrangement of the known art,

FIGS. 2 and 3 diagrammatically depict two different embodiments of the invention, FIGS. 4 and 5 diagrammatically depict a plan view and sectional illustration of a further embodiment, and FIG. 6 diagrammatically depicts a use of an embodiment of the invention for the combustion of solid materials.

In the individual exemplary embodiments, identical parts are provided with identical reference symbols. The embodiments are partially described jointly.

DETAILED DESCRIPTION OF THE PREFERRED EMBODIMENTS

In all the examples, in each case the burner is denoted by 1 and the flame by 2. The burner 1 has a gas feed 3. Furthermore, the arrangement includes at least one electrode 6, which can be used to apply electric fields to the flame. The flame is scaled along the Z coordinate.

FIG. 1 has already been dealt with in the introduction, with corresponding statements relating to the known art, to which reference is made in detail.

The first exemplary embodiment of the invention, shown in FIG. 2, illustrates the flame 2 which is generated by the burner 1 for combustibles, including fuels which are in gas form, in liquid form or in the form of a solid powder transported in gas or liquids. The fuel is guided through the burner 1 into a combustion space 4 through the fuel inlet 3. The burner 1 may include electrically conductive or nonconductive material. In the former case, the burner serves as electrode, while in the latter case an electrode 5, which in this example is in the form of a ring and closely surrounds the burner 1, is fitted. A further electrode 6 is arranged in such a way as to lie completely in the area indicated by $z \leqq 0$. The electrodes are electrically connected to the mains part 7.

In the exemplary embodiment shown in FIG. 3, a rod electrode 6*a* is arranged coaxially inside the burner, in such a manner that it only projects into the area $z>0$ sufficiently far to satisfy the condition that there should be no straight connecting line between the electrodes that passes through the flame. An electric field in the sense of an embodiment of the invention is formed between the electrode 6*a*, on the one hand, and the burner 1, on the other hand, if the latter includes electrically conductive material, or a further electrode 5, which in this specific case surrounds the burner, which is assumed to be nonconductive, in a form-fitting manner.

In a modification of an embodiment of the invention, the rod electrode 6*a* located inside the burner can be replaced by a tube or nozzle or a plurality of tubes and nozzles through which combustible or noncombustible gases or mixtures can flow. On account of the short electrode-to-electrode distance compared to the known art shown in FIG. 1, it is already possible to generate an electric field with correspondingly lower voltages.

The use of embodiments of the invention is not restricted to the combustion of liquid or gaseous fuels. FIG. 6 indicates a combustion chamber 8 in which a pile 11 of solid fuel, for example coal, is burning on a grate 10 which is electrically insulated from the combustion chamber by nonconductive support elements 9. The plane $z=0$ is defined by the top edge of the grate 10 or, if the fuel is electrically conductive, by the upper limit of the pile 11. An annular electrode 12 is arranged in such a way that it projects into the area $z>0$ at most sufficiently far to satisfy the condition that there must be no straight connecting line between the electrodes which passes through the flame.

Embodiments of the invention are not restricted either to systems which include just two electrodes, one of which may be the burner; or to electrodes which are rotationally symmetrical with respect to the burner axis, i.e. in particular annular, toroidal or cylindrical. FIGS. 4 and 5 show an exemplary embodiment in which a plurality of rod electrodes 13*a*, 13*b*, 13*c*, 13*d* are arranged radially with respect to a burner 1.

In the arrangements described with reference to FIGS. 2 to 6, the desired influencing of the combustion process by electric fields is achieved without the electric field passing through extensive parts of the flame in which it does not have a stabilizing or pollutant-reducing effect. Contact with the electrodes by electrically conductive areas of the flame is as far as possible avoided. As a result, the current induced by the electric field is considerably reduced, and the demand for electric power is reduced to the same degree. Furthermore, the likelihood of disruptive electrical sparkovers greatly decreases. The relatively short electrode-to-electrode distance leads to a reduced voltage consumption compared to the known art for the same electric field strength.

The arrangements according to an embodiment of the invention for influencing flames with the aid of electrical devices are equally suitable for operation with DC voltage, pulsed or clocked DC voltage and AC voltage, as well as DC voltage with superimposed AC voltage. If a DC voltage is used, the polarity of the burner is preferably negative.

Furthermore, sensors can be assigned to the system: a first sensor records the frequency of any combustion oscillations which may be present. A second sensor measures the pollutant concentration in the exhaust-gas stream from the flame. The sensors supply input signals for a control unit (not shown in detail) which controls the frequency, amplitude and phase of the voltage applied to the electrodes in such a manner that the combustion oscillations and the pollutant concentration are minimized.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A device for influencing a combustion operation, comprising:

field-generating electrodes for generating an electric field which is adapted to influence a flame by exerting an electric force on charge carriers produced by the flame during a combustion operation, the electrodes being arranged outside an area of the flame and being arranged on a side of a burner opening which is remote from the flame, wherein there is no straight connecting line between electrodes of opposite polarity which passes through the flame, further comprising an annular electrode directly on the burner, on the side of the burner opening which is remote from the flame.

2. The device as claimed in claim 1, further comprising at least one annular electrode, surrounding the burner.

3. The device as claimed in claim 1, wherein a rod electrode is arranged coaxially inside the burner.

4. The device as claimed in claim 3, wherein the burner is surrounded by a plurality of electrodes arranged on the circumference around the flame.

5. The device as claimed in claim 1, wherein the electrodes are arranged symmetrically around the burner.

6. The device as claimed in claim 5, wherein the electrodes are rod electrodes directed centrally at the burner.

7. The device as claimed in claim 1, further comprising:

sensors for recording the frequency and amplitude of at least one of combustion oscillations and pollutant concentration in an exhaust-gas stream, the sensors, via at least one control device, being adapted to control frequency, amplitude and phase of an applied voltage in such a way that at least one of the combustion oscillations and pollutant concentration in the exhaust gas are minimized.

* * * * *